US008406087B2

(12) United States Patent
Schneider

(10) Patent No.: US 8,406,087 B2
(45) Date of Patent: Mar. 26, 2013

(54) WATCH

(76) Inventor: Jens Schneider, Glashütte-Johnsbach (DE)

( * ) Notice: Subject to any disclaimer, the term of this patent is extended or adjusted under 35 U.S.C. 154(b) by 424 days.

(21) Appl. No.: 12/771,026

(22) Filed: Apr. 30, 2010
(Under 37 CFR 1.47)

(65) Prior Publication Data

US 2011/0090768 A1 Apr. 21, 2011

(30) Foreign Application Priority Data

Apr. 30, 2009 (DE) ..... 10 2009 019 335

(51) Int. Cl.
*G04B 19/20* (2006.01)
*G04B 19/02* (2006.01)
*G04B 19/06* (2006.01)

(52) U.S. Cl. ..... 368/77; 368/221; 368/233

(58) Field of Classification Search ..... 368/77, 368/185, 190, 221, 223, 233, 234
See application file for complete search history.

(56) References Cited

U.S. PATENT DOCUMENTS

| | | | | |
|---|---|---|---|---|
| 2,130,873 | A * | 9/1938 | Bourquin | 368/77 |
| 3,818,689 | A | 6/1974 | Müller | |
| 3,854,280 | A * | 12/1974 | Wuthrich | 368/221 |
| 3,930,359 | A * | 1/1976 | Flumm et al. | 200/38 FA |
| 3,982,388 | A | 9/1976 | Guyot et al. | |
| 7,075,860 | B2 * | 7/2006 | Dias | 368/77 |
| 2006/0215498 | A1 * | 9/2006 | Meier | 368/223 |

FOREIGN PATENT DOCUMENTS

| | | |
|---|---|---|
| FR | 1186707 | 8/1959 |

* cited by examiner

*Primary Examiner* — Vit W Miska
(74) *Attorney, Agent, or Firm* — Cozen O'Connor

(57) ABSTRACT

A watch with a drive by which a gear train of a digital display having one or more number disks driven in rotation in cyclical steps and a manually actuatable disk adjusting mechanism. A drive wheel is advanced rotationally in steps by the drive of the watch and rotationally blocked between the steps. A unit wheel of a unit number disk can be rotationally advanced at ten steps per revolution. A stepping device, driven by the unit wheel drives a tens number disk rotationally at six steps per revolution. An hours number disk, is rotationally advanced directly or indirectly by the tens number disk at twelve steps per revolution during one revolution of the tens number disk.

25 Claims, 8 Drawing Sheets

WATCH

BACKGROUND OF THE INVENTION

1. Field of the Invention

The invention pertains to a watch, especially to a wristwatch, with a drive, by which a gear train of a digital display comprising one or more number disks can be driven rotatably in cyclical steps having a manually actuatable disk adjusting mechanism 2. Description of the Related Art In the digital display of a watch, strong stepping forces are required to advance the number disks cyclically in steps.

SUMMARY OF THE INVENTION

A goal of the invention is to create a watch, the wheelwork of which, while being small in size, can be advanced with the least possible amount of force.

According to one embodiment of the invention a drive wheel can be advanced rotatably in cyclical steps by the drive of the watch but is prevented from rotating between the steps. The drive wheel rotationally advances a unit wheel of a unit number disk at ten steps per revolution. A stepping device, driven by the unit wheel, by which a tens number disk can be rotationally advanced at six steps per revolution, and with an hours number disk, which, during one rotation of the tens number disk, can be rotationally advanced at twelve steps per revolution directly or indirectly by the tens number disk.

This design of the wheelwork as a continuous gear train with sequentially driven number disks requires only a few components, with the result that the frictional forces to be overcome when the wheels are to be advanced are minimized.

This is especially important when the hours number disk is to be advanced, because for this to happen, all of the other number disks must also be advanced and thus the frictional forces to be overcome are at their maximum level.

Because the drive wheel is preferably rotationally blocked by the drive between the cyclical steps, no special device is needed to hold the unit number disk exactly in position, and therefore there is no device which would increase the frictional forces to be overcome.

Holding the additional number disks in their exact positions is achieved by a first and a second rotational blocking device that prevent the tens number disk and/or the hours number disk from rotating out of their advanced positions; when the tens number disk and/or the hours number disk are to be advanced, these blocking devices can be shifted from their rotational blocking position into a release position.

Because, when in their release position, the rotational blocking devices offer no resistance to be overcome during the disk-advance phases, the required expenditure of force for the disk adjusting mechanism can be kept low.

Simple way of achieving a stepwise advance of the unit number disk is a unit wheel, fixedly connected coaxially to the unit number disk, can be rotationally advanced by the drive wheel, acting by way of a pinion, at ten steps per revolution.

In one embodiment, for the advance of the tens number disk a stepping wheel of the stepping device can be rotationally advanced by the unit wheel at six steps per revolution and one revolution per minute, wherein one or more radially projecting stepping fingers, fixedly connected to the stepping wheel, can engage in a six-tooth starwheel fixedly connected coaxially to the tens number disk.

If each of the one or more stepping fingers carries a jewel, by which it engages with the starwheel, the frictional resistance is kept low during the stepwise advance of the starwheel.

A precise stepping movement is achieved with only a few components by permanently connecting one or more radially projecting stepping teeth to the tens number disk. These teeth can then rotationally advance an hours gear ring, which is fixedly connected coaxially to the hours number disk, at one step per revolution of the tens number disk, wherein the one or more stepping teeth can rotatably advance a starwheel, which is fixedly connected coaxially to the intermediate hours wheel and which engages in the hours gear ring.

A forceless rotational blocking of the tens number disk and/or of the hours number disk is achieved in a simple manner by using the first and/or the second rotational blocking device to block positively the tens number disk and/or the hours number disk.

Little space is required if the first rotational blocking device comprises a first blocking ring that can be rotationally driven at six steps per revolution and one revolution per minute around an axis of rotation which is parallel to the axis of rotation of the hours number disk, and if a first blocking starwheel with six radial blocking recesses and corresponding radial blocking elevations arranged uniformly and in alternating fashion around the circumference is fixedly connected coaxially to the hours number disk, wherein the radially outward-facing circumferential lateral surface of the blocking ring engages in one of the blocking recesses, the blocking ring also being provided with a radially inward-facing notch, through which the blocking elevations are able to move freely.

In spite of the blocking engagement of the blocking ring in the blocking recesses, the blocking ring can continue to rotate when in the rotational blocking position, if the blocking recesses comprise an arc-shaped contour corresponding to the circular peripheral contour of the blocking ring.

The blocking ring is preferably fixedly connected coaxially to the stepping tooth, and the notch is radially aligned or oriented in correspondence with the stepping tooth.

In one embodiment of the invention requiring only a small amount of space is achieved in that the second rotational blocking device comprises a second blocking ring fixedly connected coaxially to the hours number disk; this second blocking ring engages in the blocking recesses of a second blocking starwheel with radial second blocking recesses and radial second blocking elevations distributed uniformly and in alternating fashion around the circumference and is fixedly connected coaxially to the starwheel, wherein the radially outward-facing circumferential lateral surface of the second blocking ring engages in one of the second blocking recesses, the second blocking ring also being provided with radially inward-pointing second notches, corresponding to the number of stepping teeth, through which notches the second blocking elevations are able to move freely.

As in the case of the first rotational blocking device, the second rotational blocking device for the second blocking recesses preferably comprises an arc-shaped contour corresponding to the circumferential contour of the second blocking ring and for the second notches to be radially oriented in correspondence with the one or more stepping teeth.

If one or more of the number disks is designed in a ring-like manner, then, in a simple manner that reduces the amount of space required, shafts of the wheelwork can project through the internal area of a ring-like number disk.

It is especially advantageous when at least the unit number disk or the tens number disk is arranged inside the outer circumferential contour of the hours number disk.

Through the use of this design, the overall arrangement of the number disks takes up a small amount of space, so that a digital display of this type can be used even for small wristwatches in spite of the relatively large size of the number displays.

If a pinion, which can engage in the gear train, can be driven in rotation by a first disk adjusting wheel, which can be turned manually, wherein the pinion is coupled nonpositively to the drive wheel by a locking mechanism, then the number disks can be moved manually in both adjusting directions with only a few space-saving components.

A design of the locking mechanism comprises the pinion and the drive wheel are able to turn around a common axis of rotation. The locking mechanism comprises a finger, which projects radially from the axis of rotation, is connected nonrotatably to the pinion. The finger engages axially under the force of a spring in an indent in a crown-like latching hub, which is connected coaxially to the drive wheel and comprises several radially outward-facing indents, distributed uniformly around the circumference.

In a simple manner, the pinion and the finger are mounted firmly on a rotatably supported shaft, on which the drive wheel with the latching hub is supported with the freedom to rotate and to shift axially between a latching position and a raised nonlatching position. A spring preferably pushes the drive wheel axially toward the finger and into the latching position.

To reduce the adjusting forces, a roller or bushing can be supported rotatably on the finger.

To save space, the spring can be a spiral coiled compression spring, which surrounds the shaft, one end of the spring being firmly supported on the shaft, the other end resting under pretension against the drive wheel.

If manual adjustability is to be possible only when an adjustment is to be made, a coupling pinion which is, mounted on an adjusting shaft that can be manually rotated by a crown, can be moved between a coupled position, in which it is engaged with the first disk adjusting wheel, and a decoupled position, in which it is disengaged from the first disk adjusting wheel.

Because both the drive of the watch and the manual adjustment act on the gear train of the disk adjustment wheelwork by the drive wheel, the gear train of the manual adjustment could interfere with the stepwise advance of the unit number disk. Such interference is avoided by providing clearance between the first disk adjusting wheel and the pinion, the pinion being free to rotate around this clearance over a certain angular range relative to the disk adjusting wheel.

The pinion can be driven in rotation by the first disk adjusting wheel, acting by way of a second disk adjusting wheel and an adjusting pinion. The second disk adjusting wheel is mounted with freedom to rotate around the given angular range on an adjusting wheel shaft connected nonrotatably to the pinion.

In a simple and space-saving manner, the clearance is created in that the second disk adjusting wheel has a pin, projecting parallel to the axis, which is free to rotate along with the second disk wheel around the given angular range between two stops permanently connected to the adjusting wheel shaft. A circular disk can be permanently mounted on the adjusting wheel shaft that has a radially outward-facing circumferential recess in the form of a sector of a circle extending around the given angle, into which the pin projects.

The ends of the sector-like recess form the stops.

An exemplary embodiment of the invention is shown in the drawing and is described in greater detail below.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
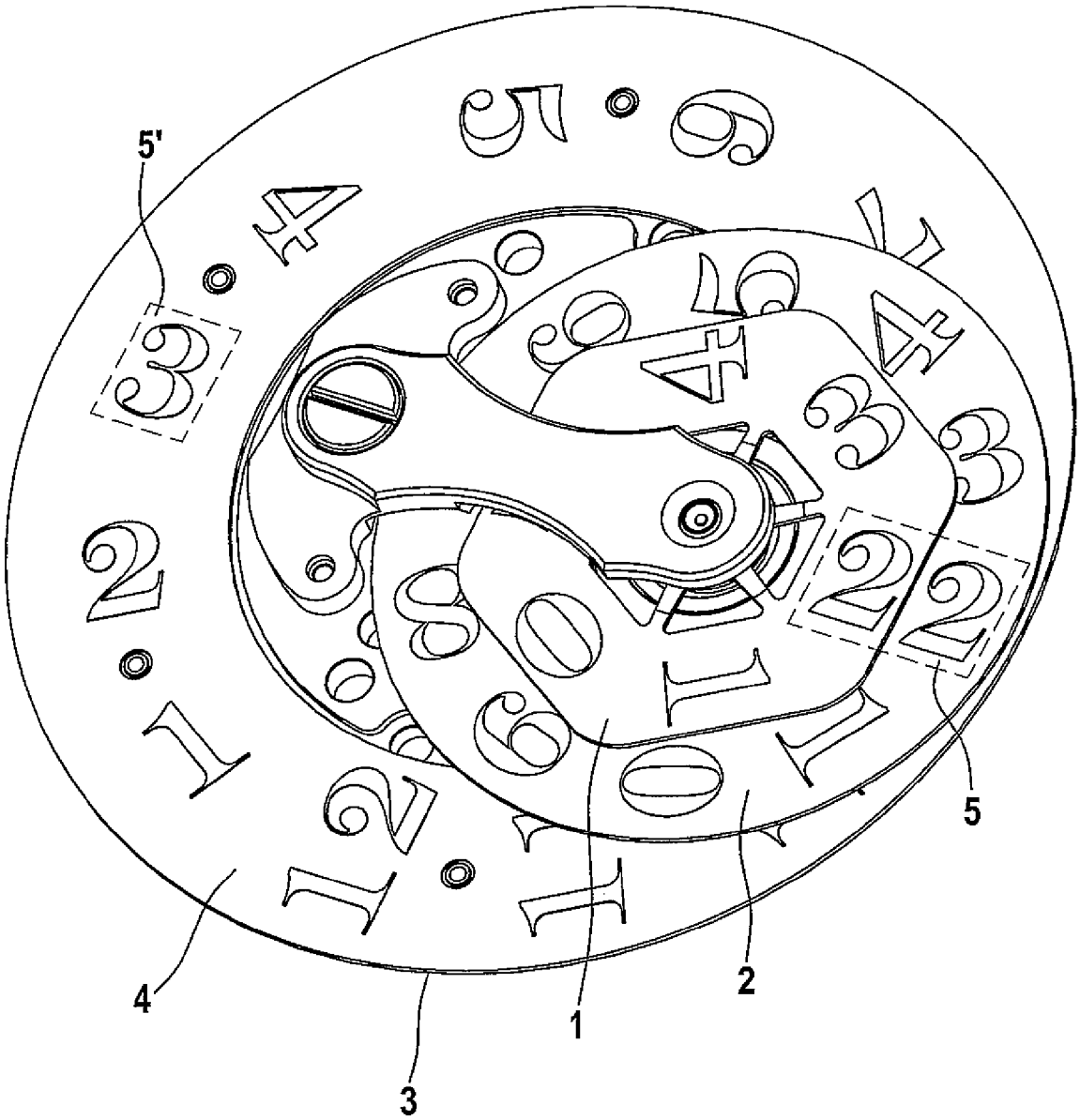
FIG. 1 is a perspective view of the number disks of a digital display of a wristwatch.

FIG. 1 shows the number disks of a digital display of a wristwatch.

A tens number disk 1 is arranged parallel to and in front of a unit number disk 2.

The tens number disk 1 and the unit number disk 2 are coaxial to each other and arranged inside the outer circumferential contour 3 of a ring-like hours number disk 4, which is located in a plane parallel to the tens number disk 1 and the unit number disk 2.

The numbers 0-5 are distributed uniformly around the circumference of the tens number disk 1, the numbers 0-9 around the unit number disk 2, and the numbers 1-12 around the hours number disk 4

Windows 5, 5', which are formed in a dial (not shown) covering the number disks, are shown in broken line.

Thus an observer sees only the numbers which represent the time to be displayed.

In the present case, the indicated time is 3:22.

The watch has a drive 7 with a remontoir a constant force device, by which a drive wheel 6 is driven by a transmission pinion 8 in cyclical, preferably one-minute steps.

Figure 4:
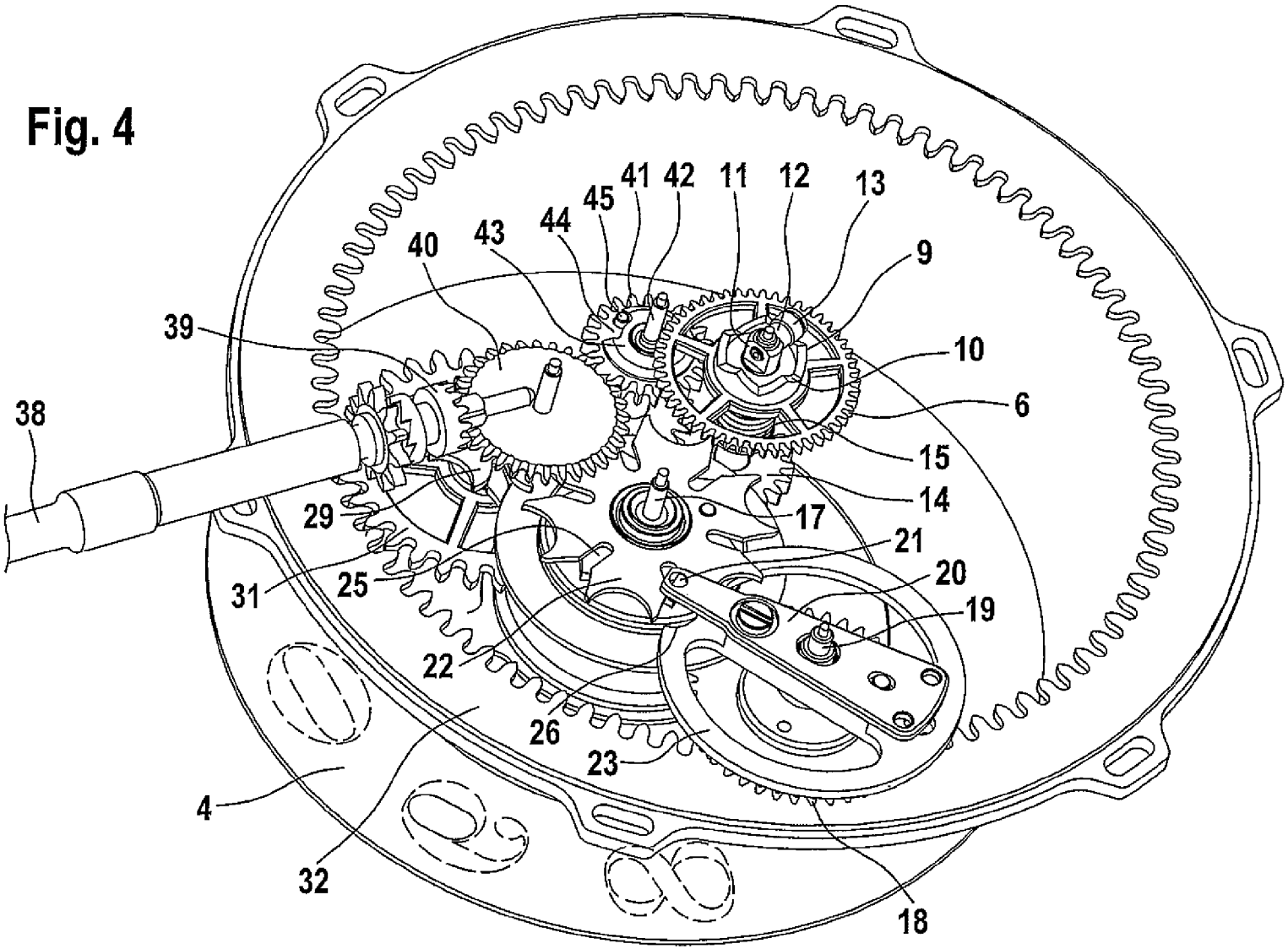
FIG. 4 is a perspective view from above of the wheelwork according to FIG. 2.

The drive wheel 6 has a coaxial, crown-shaped latching hub 9 with axially oriented, V-shaped indents 10 shown in FIG. 4.

The drive wheel 6 comprises a coaxial bore, by which the drive wheel 6 and the latching hub 9 are supported on a shaft 11 so that they can both rotate and move axially.

One free end of the shaft 11 projects through the coaxial bore in the drive wheel 6 and comprises a finger 12, projecting radially away from the shaft 11. A bushing 13 is supported in freely rotatably fashion on the finger 12.

Figure 2:
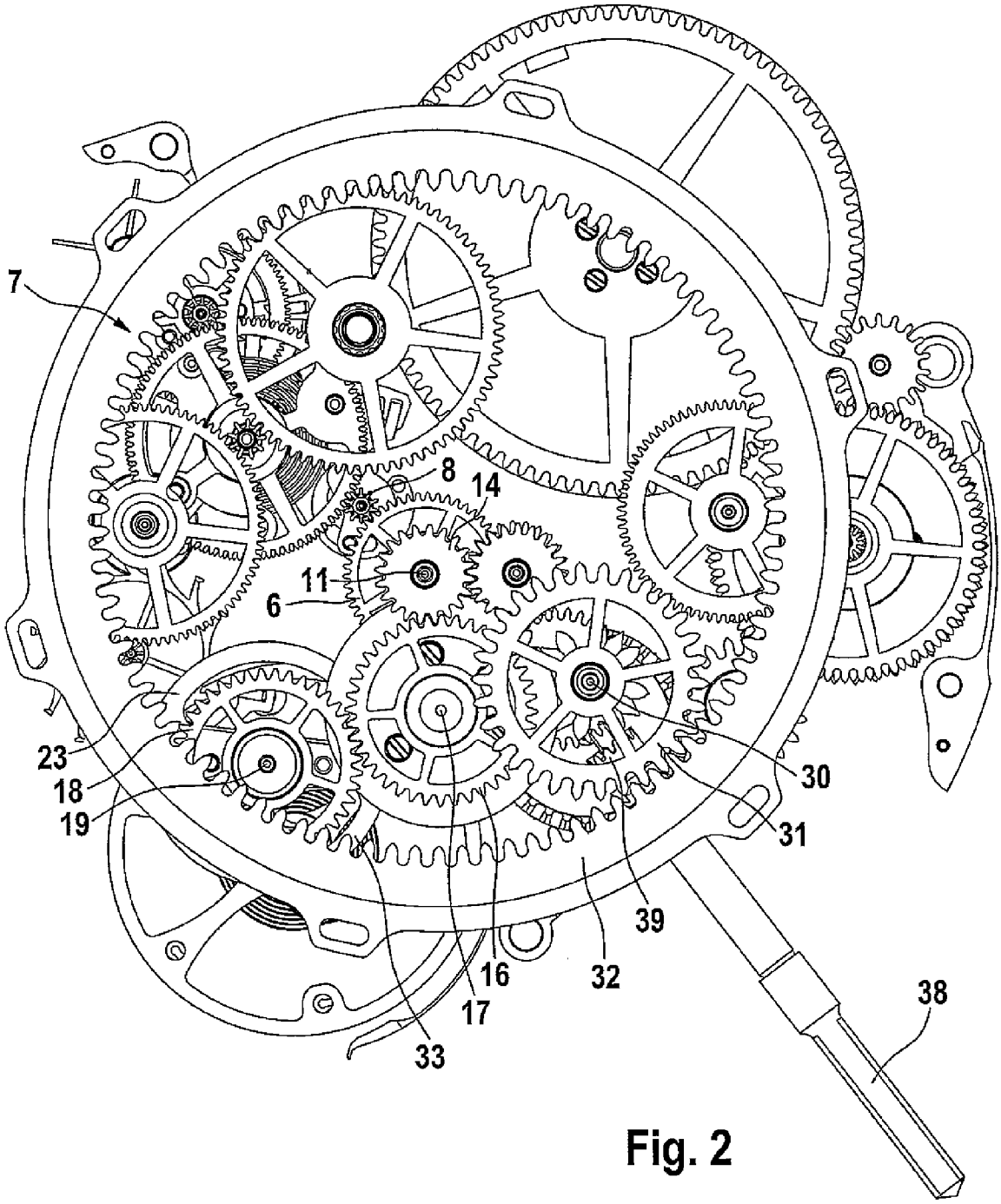
FIG. 2 is a view from below of the wheelwork of the wristwatch according to FIG. 1.

A pinion 14 is permanently mounted on the other free end of the shaft 11. (FIG. 2).

Between the pinion 14 and the drive wheel 6, the shaft 11 is surrounded with a certain amount of play by a spiral coiled compression spring 15, one end of which is supported on the pinion 14, whereas the other end rests under pretension against the drive wheel 6. (FIG. 4).

As a result, the finger 14 is drawn into one of the indents 10 in the latching hub 9 and rests there by way of the bushing 13 at a lowermost point of the indent 10 under pretension, so that the shaft 11 is held in an exact position.

The pinion 14 engages in a unit wheel 16, which carries the unit number disk 2 coaxially, this disk 2 being supported in freely rotatable fashion on a tens shaft 17. The unit wheel 16 engages in a tens stepping wheel 18, which is connected nonrotatably to a coaxial stepping shaft 19 and has a radially projecting stepping finger 20.

Figure 3:
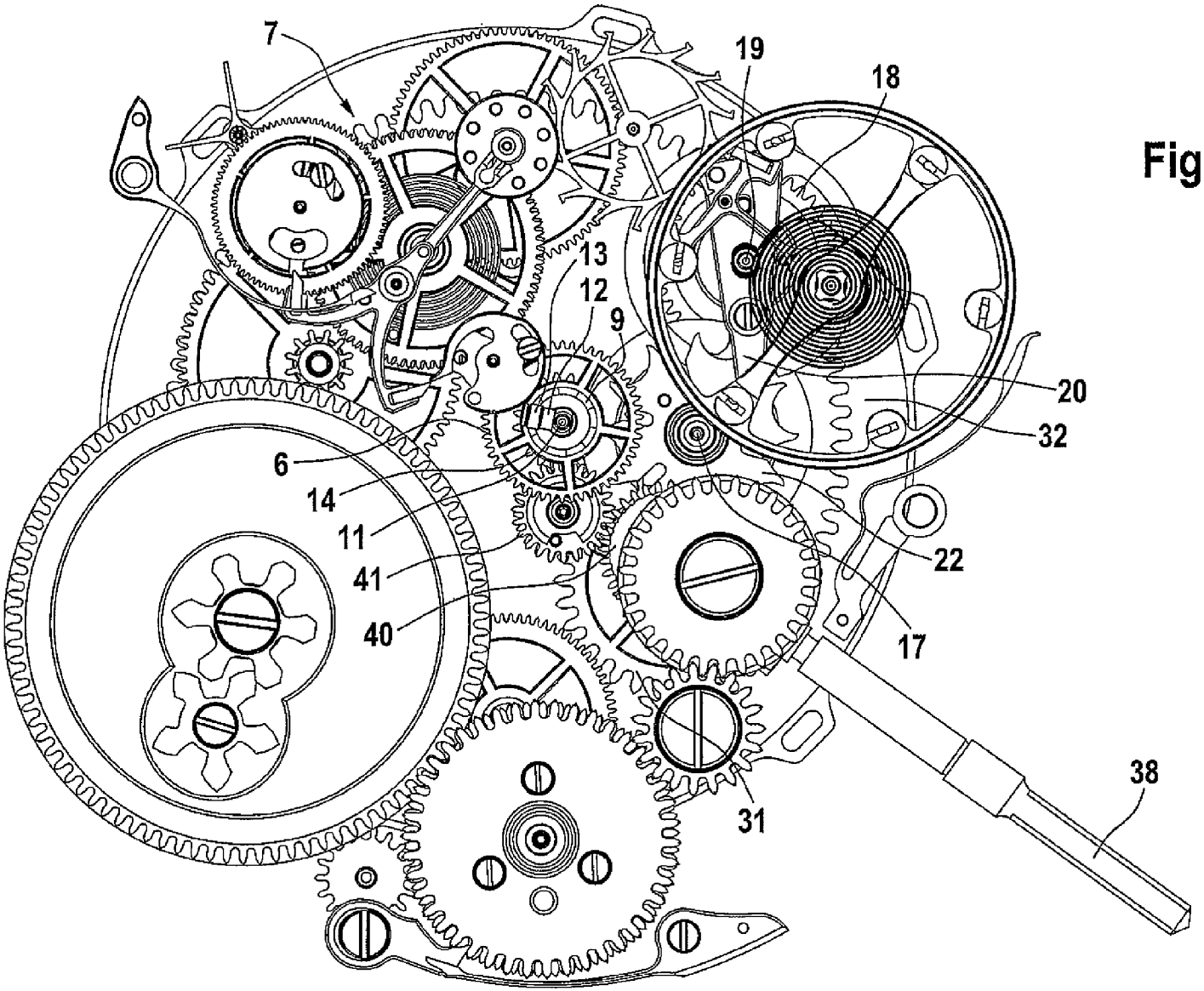
FIG. 3 is a view from above of the wheelwork according to FIG. 2.

On its radially outer end, the stepping finger 20 carries a jewel 21, by which it can engage in a six-toothed starwheel 22 and thus step it forward. (FIGS. 3, 4).

The starwheel 22 and also the tens number disk 1 are permanently mounted on the tens shaft 17.

After each revolution of the stepping 20 finger, the jewel 21 engages in the starwheel 22 and advances it by one-sixth of a revolution in synchrony with the movement of the unit disk, i.e., from "9" to "0".

As a result, the tens disk 1 mounted on the tens shaft 17 also advances by exactly one number.

So that the tens shaft 17 cannot move freely outside of one of these stepping phases, the circular circumferential contour of a blocking ring 23, mounted permanently on the stepping shaft 19, engages in a first blocking recess 24 of a first blocking starwheel 25, the recess 24 being provided with an arc-shaped contour corresponding to that of the ring. The blocking starwheel 25 comprises six first blocking recesses 24 and corresponding first blocking elevations 27 uniformly distributed around its circumference.

The first blocking starwheel 25 is fixedly mounted on the tens shaft 17.

Thus the first blocking starwheel 25 is positively blocked and cannot turn.

A radially inward-directed first notch 26, which is radially aligned or oriented in correspondence with the stepping finger 20, is formed in the radially outward-facing circumferential lateral surface of the first blocking ring 23.

During a stepping phase the blocking action of the first blocking starwheel 25 is suspended when one of the first blocking elevations 27 enters the first notch 26.

After a complete revolution, the tens shaft 17 advances the hours number disk 4 by one step. For this purpose, the tens shaft 17 carries a radially projecting stepping tooth 28, which engages in a starwheel 29.

Figure 7:
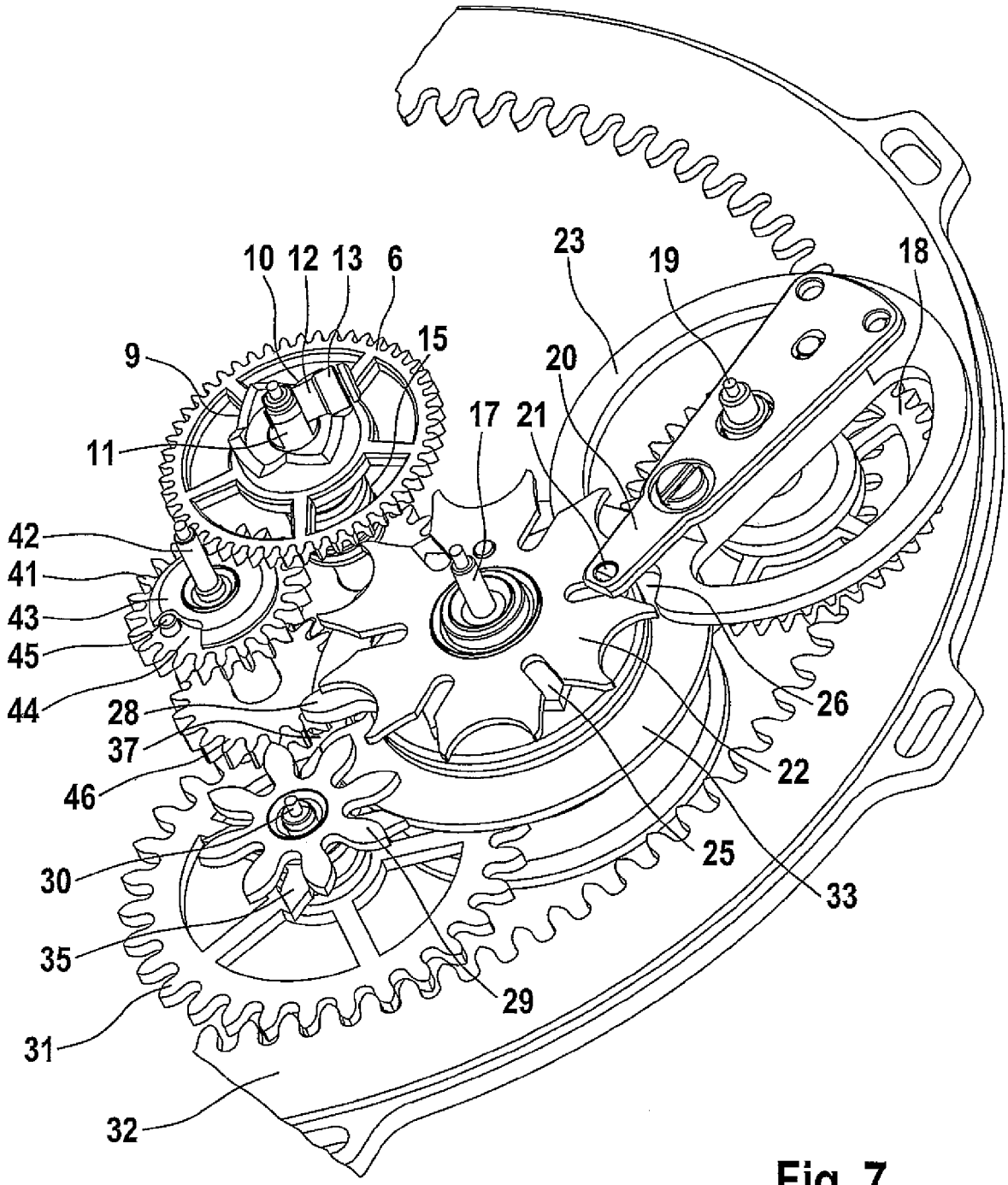
FIG. 7 is an enlarged perspective view from above of the wheelwork according to FIG. 3.
Figure 8:
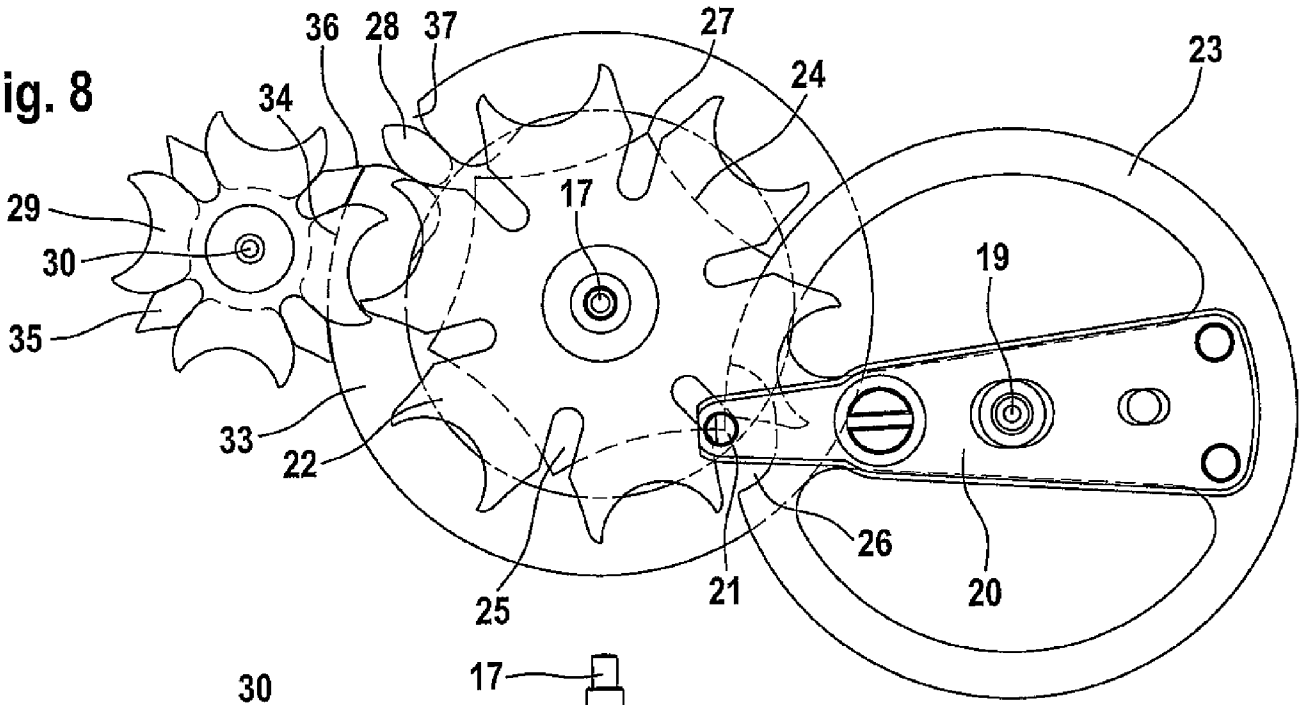
FIG. 8 is a view from above of a partial area of the wheelwork according to FIG. 2.

In FIGS. 2-7, the starwheel 29 has eight teeth, whereas, in FIG. 8, it is designed with four teeth.

Upon the transition of the tens number disk 1 from "5" to "0", the starwheel 29 is advanced by the stepping tooth 28 by one-fourth of a revolution.

The starwheel 29 is fixedly mounted on an hours shaft 30.

Figure 5:
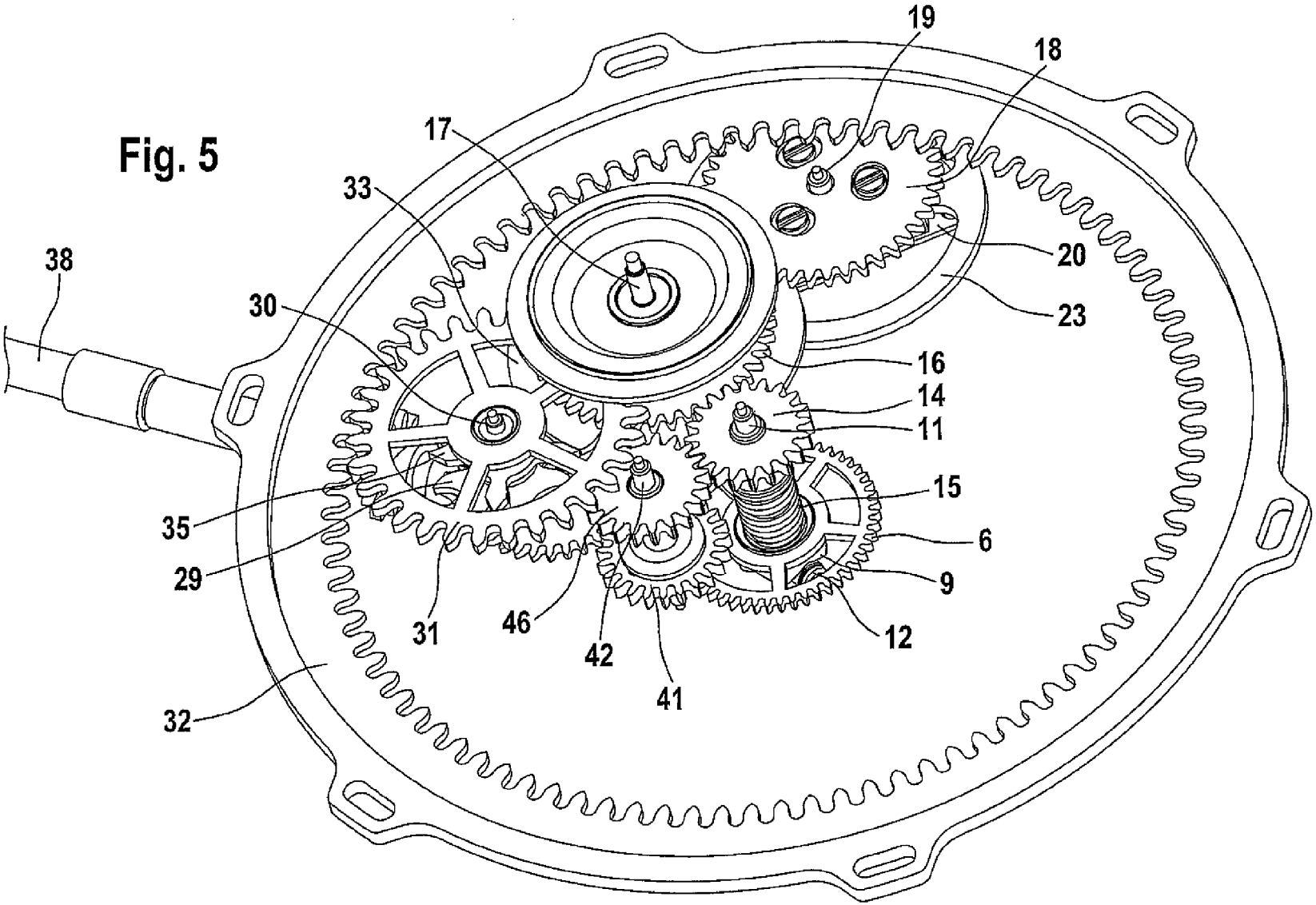
FIG. 5 is a perspective view from below of the wheelwork according to FIG. 2.
Figure 6:
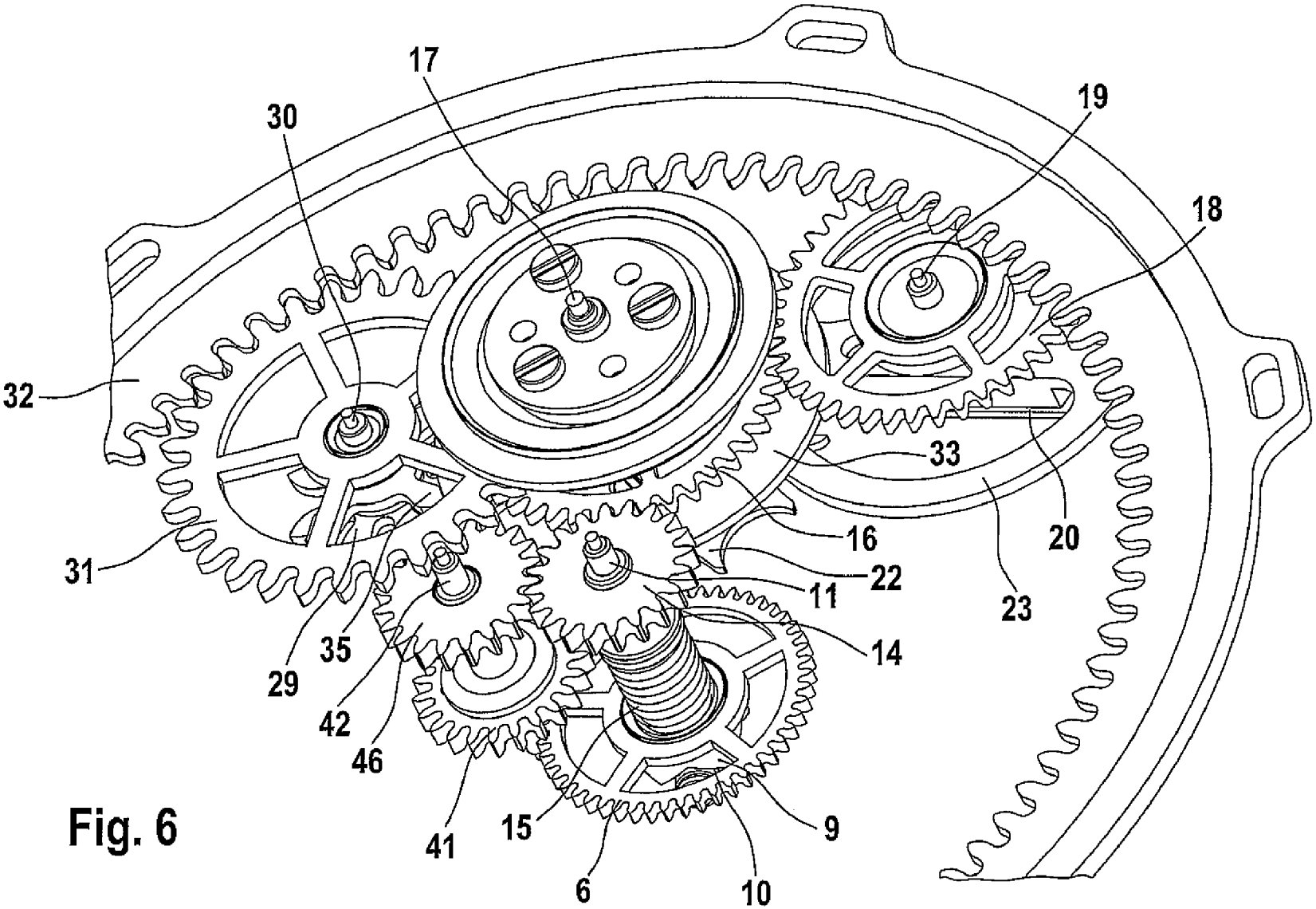
FIG. 6 is an enlarged perspective from below of the wheelwork according to FIG. 2.

An intermediate hours wheel 31 is fixedly mounted on the hours shaft 30. This intermediate wheel engages in a rotatably supported hours gear ring 32 provided with an internal set of teeth. (FIG. 5, 6).

The hours gear ring 32 carries coaxially the hours number disk 4, which therefore is advanced by the intermediate hours wheel 31 at the rate of twelve steps per hour.

So that the hours shaft 30 is not free to move outside the stepping phase, the circular circumferential contour of a second blocking ring 33, which is fixedly mounted on the tens shaft 17, engages in a second blocking recess 34 of a second blocking starwheel 35, the recess being provided with an arc-shaped contour corresponding to that of the blocking ring. The blocking starwheel comprises four second blocking recesses 34 and corresponding second blocking elevations 36 uniformly distributed around its circumference. (FIG. 8).

Figure 9:
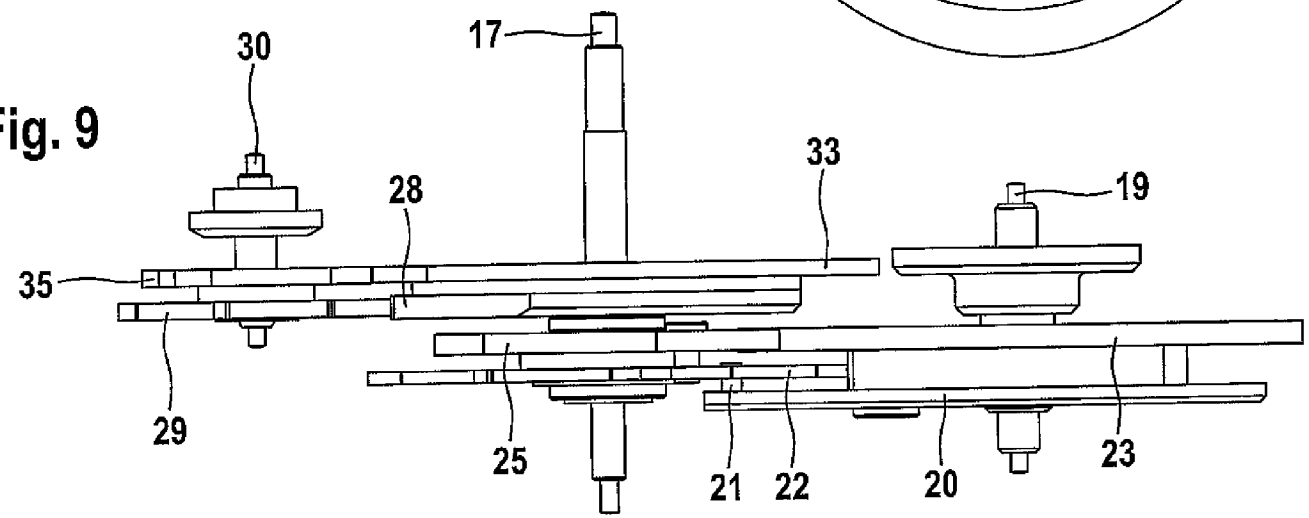
FIG. 9 is a side view of the partial area of the wheelwork according to FIG. 8.

The second blocking starwheel 35 is fixedly mounted on the hours shaft 30. Thus the blocking starwheel 35 is positively blocked and cannot turn. (FIG. 9).

A second, radially inward-directed notch 37, which is radially oriented in correspondence with the stepping tooth 28, is formed in the radially outward-facing circumferential lateral surface of the second blocking ring 33.

During a stepping phase, therefore, the blocking action of the second blocking starwheel 35 is suspended when one of the second blocking elevations 36 enters the second notch 36.

At its radially inner end, a radially outward-projecting adjusting shaft 38 carries a coupling pinion 39, which, by the axial displacement of the adjusting shaft 38, can be moved from its decoupled position and into its coupled position, in which it engages with the teeth of a first disk adjusting wheel 40, (FIG. 2).

Manually rotating the adjusting shaft 38 when it is in the coupled position has the effect of rotating the first disk adjusting wheel 40.

The first disk adjusting wheel 40 engages in a second disk adjusting wheel 41, which is supported on an adjusting wheel shaft 42 with freedom to rotate around a certain angular range. (FIG. 4).

For this purpose, a circular disk 43 is fixedly mounted on the adjusting wheel shaft 42, axially adjacent to the second disk adjusting wheel 41. The circumference of this circular disk comprises a radially outward-facing recess 44 in the form of a sector of a circle extending around a certain angle.

A pin 45, which is parallel to the adjusting wheel shaft 42 and which is permanently connected to the second disk adjusting wheel 41, projects into recess 44. (FIG. 4).

The two circumferential ends of the recess 44 form stops, against which the pin 45 can come to rest and which thus limit the relative rotation between the second disk adjusting wheel 41 and the adjusting wheel shaft 42. (FIG. 7).

An adjusting pinion 46, which engages in the pinion 14, is also fixedly mounted on the adjusting wheel shaft 42.

When the coupling pinion 39 is in the coupled state, the number disks 1, 2, and 4 can be adjusted by manually turning the adjusting shaft 38, which rotates the pinion 14 by way of the adjusting pinion 46.

Because the drive wheel 6 is simultaneously blocked from rotating between the cyclical drive steps by the drive 7, the drive wheel 6 cannot rotate concomitantly with the manually driven pinion 14. The force of the spiral coiled compression spring 15 being overcome, the drive wheel 6 and the latching hub 9 are axially displaced, so that the finger 12 moves out of its indent 10 in the latching hub 9 and latches itself again in a new adjacent indent 10. (FIG. 3).

Thus the pinion 14 and the drive wheel 6 rotate relative to each other by an amount of one step, which corresponds to a step or to part of a step of the drive wheel 6, so that, as a result, the gear train is actuated in a stepwise manner to adjust the number disks 1, 2, and 4.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A watch, comprising:

a drive;

a drive wheel configured to be rotatably advanced in cyclical steps by the drive and prevented from rotating between the cyclical steps;

a gear train of a digital display comprising:

a unit wheel of a unit number disk configured to be driven in rotation in cyclical steps and rotatably advanced by the drive wheel at a rate of ten steps per revolution;

a stepping device driven by the unit wheel, by which a tens number disk is configured to be driven in rotation in cyclical steps and rotatably advanced at six steps per revolution; and an hours number disk, configured to be driven in rotation in cyclical steps and rotatably advanced during one revolution of the tens number disk one of directly and indirectly by the tens number disk at twelve steps per revolution; and a manually actuatable disk adjusting mechanism configured to adjust at least one of the unit number disk, the tens number disk, and the hours number disk.

2. The watch according to claim 1, further comprising:

at least one of a first and a second rotational blocking device, configured to be shiftable from a rotational blocking position into a release position during a forward-stepping phase of at least one of the tens number disk and of the hours number disk, wherein at least one of the tens number disk and the hours number disk is blocked from rotating in its forward-stepped positions by at least one of the first and the second rotational blocking device.

3. The watch according to claim 1, further comprising:

a pinion;

wherein the unit wheel is fixedly connected coaxially to the unit number disk and configured to be rotatably advanced by the drive wheel by the pinion at ten steps per revolution.

4. The watch according to claim 3, further comprising:

a six-toothed starwheel fixedly connected coaxially to the tens number disk; and one or more radially projecting stepping fingers fixedly connected to the tens stepping wheel are configured to engage in the six-toothed starwheel;

wherein the stepping device comprises a tens stepping wheel configured to be rotatably advanced by the unit wheel at six steps per revolution and one revolution per minute.

5. The watch according to claim 4, wherein each of the one or more stepping fingers further comprise a jewel by which it engages in the starwheel.

6. The watch according to claim 4, further comprising one or more radially projecting stepping teeth is fixedly connected to the tens number disk configured to rotationally advanced an hours gear ring fixedly connected to the hours number disk at one step per revolution of the tens number disk.

7. The watch according to claim 6, further comprising:

an intermediate hours wheel; and a starwheel that is nonrotatably connected coaxially to the intermediate hours wheel and configured to engage in the hours gear ring and be rotationally advanced by the one or more stepping teeth.

8. The watch according to claim 2, wherein at least one of the tens number disk and the hours number disk is positively blocked from rotating by at least one of the first and the second rotational blocking device.

9. The watch according to claim 8, wherein the first rotational blocking device comprises a first blocking ring configured to be driven in rotation at six steps per revolution and one revolution per minute around an axis of rotation parallel to an axis of rotation of the hours number disk, and a first blocking star wheel fixedly connected coaxially to the hours number disk comprises six radial blocking recesses and radial blocking elevations distributed uniformly in alternation around the circumference, wherein a radially outward-facing circumferential lateral surface of the blocking ring engages in one of the blocking recesses and is provided with a radially inward-facing notch, through which the blocking elevations are able to move freely.

10. The watch according to claim 9, wherein the blocking recesses comprise an arc-shaped contour that corresponds to a circular circumferential contour of the blocking ring.

11. The watch according to claim 9, wherein the blocking ring is fixedly connected coaxially to the stepping tooth, and the notch is radially aligned with the stepping tooth.

12. The watch according to claim 6, wherein the second rotational blocking device comprises a second blocking ring that is fixedly connected coaxially to the hours number disk and the starwheel configured to engage in second blocking recesses of a second blocking starwheel having radial second blocking elevations distributed uniformly around the circumference, and a radially outward-facing circumferential lateral surface of the second blocking ring engages in one of the second blocking recesses and is provided with radially inward-pointing second notches corresponding to the number of stepping teeth, through which notches the second blocking elevations are able to move freely.

13. The watch according to claim 12, wherein the second blocking recesses comprise an arc-shaped contour corresponding to the circumferential contour of the second blocking ring.

14. The watch according to claim 12, wherein the second notches are arranged radially in correspondence with the one or more stepping teeth.

15. The watch according to claim 1, wherein the number disks are configured as rings.

16. The watch according to claim 15, wherein at least one of the unit number disk and the tens number disk is arranged within an outer circumferential contour of the hours number disk.

17. The watch according to claim 1, further comprising a pinion configured to engage in the gear train that can be driven by a manually rotated first disk adjusting wheel, wherein the pinion is coupled nonpositively to the drive wheel by a locking mechanism.

18. The watch according to claim 17, wherein the pinion and the drive wheel can rotate around a common axis of rotation, and the locking mechanism comprises a finger projecting radially from the axis of rotation and connected nonrotatably to the pinion, which finger, under the force of a spring, engages axially in an indent of a crown-like latching hub, which is connected coaxially to the drive wheel and comprises several radially-oriented indents distributed uniformly around the circumference.

19. The watch according to claim 18, wherein the pinion and the finger are mounted fixedly on a rotatably supported shaft, on which the drive wheel with the latching hub is supported so that it can rotate and also shift axially between a latching position and a raised nonlatching position, wherein a spring pushes the drive wheel axially toward the finger and into the latching position.

20. The watch according to claim 19, wherein the spring is a spiral coiled compression spring surrounding the shaft, one end of the spring permanently connected to the shaft, the other end resting under pretension against the drive wheel.

21. The watch according to claim 17, wherein a coupling pinion, mounted on an adjusting shaft is configured to be rotated manually between a coupled position, in which it is engaged with the first disk adjusting wheel, and a decoupled position, in which it is disengaged from the first disk adjusting wheel by a crown.

22. The watch according to claim 21, wherein, between the first disk adjusting wheel and the pinion, a clearance is present, around which the pinion can freely rotate over a certain angular range relative to the disk adjusting wheel.

23. The watch according to claim 22, wherein the pinion is configured to be driven in rotation by the first disk adjusting wheel acting by way of a second disk adjusting wheel and an adjusting pinion, wherein the second disk adjusting wheel is mounted on an adjusting wheel shaft connected nonrotatably to the pinion in such a way that it can rotate freely around the given angular range.

24. The watch according to claim 23, wherein the second disk adjusting wheel comprises a pin projecting parallel to the axis, configured to rotate freely along with the second disk wheel around the given angular range between two stops fixedly connected to the adjusting wheel shaft.

25. The watch according to claim 24, wherein a circular disk, which comprises a radially outward-facing circumferential recess in the form of a sector of a circle extending around the given angle, into which the pin projects, is mounted fixedly on the adjusting wheel shaft.

* * * * *